US005732319A

United States Patent [19]

Komuro et al.

[11] Patent Number: 5,732,319

[45] Date of Patent: Mar. 24, 1998

[54] PRESSURE ROLLER HAVING DEFLECTION COMPENSATING SHAFT

[75] Inventors: Akihiro Komuro; Hirofumi Nakayasu, both of Kawasaki, Japan

[73] Assignee: Fujitsu Limited, Kawasaki, Japan

[21] Appl. No.: 626,995

[22] Filed: Apr. 3, 1996

[30] Foreign Application Priority Data

Jul. 25, 1995 [JP] Japan ..... 7-188739

[51] Int. Cl.[6] ..... G03G 15/20

[52] U.S. Cl. ..... 399/331; 399/406

[58] Field of Search ..... 355/282, 285, 355/290, 295; 100/162 B; 492/27; 226/184; 399/331, 333, 328, 330, 406

[56] References Cited

U.S. PATENT DOCUMENTS

| | | | |
|---|---|---|---|
| 1,619,371 | 3/1927 | Rogers et al. | 492/27 X |
| 2,676,387 | 4/1954 | McArn | 100/162 B X |
| 4,042,804 | 8/1977 | Moser | 492/27 X |
| 4,253,392 | 3/1981 | Brandon et al. | 492/27 X |
| 4,487,122 | 12/1984 | George et al. | 100/162 B X |
| 4,501,483 | 2/1985 | Romansky et al. | 355/284 |
| 4,942,434 | 7/1990 | Nakai et al. | 355/290 |
| 5,195,430 | 3/1993 | Rise | 355/295 X |
| 5,467,178 | 11/1995 | Mui et al. | 355/285 |

*Primary Examiner*—Nestor R. Ramirez

*Attorney, Agent, or Firm*—Nikaido, Marmelstein, Murray & Oram LLP

[57] ABSTRACT

A heat roller fixing device which can substantially make uniform the amount of deflection of a backup roller over the axial length thereof to improve a paper feed force at an axially central portion of the backup roller. The heat roller fixing device includes a heat roller rotatably mounted to a frame, and a backup roller pressed against a heat roller by coil springs to follow rotation of the heat roller. The backup roller includes a hollow cylinder, a solid metal shaft inserted in the hollow cylinder and having a pair of large-diameter portions spaced a given distance from each other. One of the large-diameter portions of the solid metal shaft is fixed to the hollow cylinder such as by a pin therethrough, and the solid metal shaft is biased toward the heat roller by the coil springs.

5 Claims, 7 Drawing Sheets

PRESSURE ROLLER HAVING DEFLECTION COMPENSATING SHAFT

BACKGROUND OF THE INVENTION

1. Field of the Invention

The present invention relates to a heat roller fixing device for fixing a toner image on a sheet of paper for use in an electrophotographic printer or the like.

2. Description of the Related Art

In an electrophotographic image forming device such as a laser beam printer or an LED printer, an electrostatic latent image according to image information is formed by exposure on a photosensitive member uniformly charged. The electrostatic latent image thus formed is developed to form a toner image on the photosensitive member, and the toner image is next transferred onto a sheet of paper. Thereafter, the toner image on the paper is fixed to obtain a hard copy. In most cases, practical fixing means for fixing such a toner image utilizes heat and/or pressure. Examples of such practical fixing means include an oven fuser having a heating element opposed to a sheet of paper to be fed, for radiating heat to the paper to thereby fix a toner image on the paper, and a heat roller fuser having a heat roller and a backup roller (pressure roller) kept in pressure contact with each other and adapted to sandwich a sheet of paper between these rollers rotated.

Conventionally known is an electrophotographic printer having a transfer roller for transferring a toner image formed on a photosensitive drum onto a sheet of paper. A bias voltage whose polarity is reverse to the polarity of charges of the toner image is applied to the transfer roller, thereby electrostatically transferring the toner image on the photosensitive drum onto the paper being fed between the photosensitive drum and the transfer roller.

In such an electrophotographic printer, the paper feed speed of the transfer roller is not constant because the coefficients of friction of the photosensitive drum and the transfer roller vary with time. To cope with this problem, the paper feed speed of the transfer roller must be made equal to the peripheral speed of the photosensitive drum. To this end, the paper feed speed of a heat roller fuser is set slightly higher than the paper feed speed of the transfer roller, thus making the paper feed speed of the transfer roller always equal to the peripheral speed of the photosensitive drum.

FIG. 11 shows a conventional heat roller fixing device in sectional elevation. The heat roller fixing device shown in FIG. 11 is composed of a heat roller 2 in which a heater (not shown) is inserted, and a backup roller (pressure roller) 4 kept in pressure contact with the heat roller 2 to follow rotation of the heat roller 2. The backup roller 4 is composed of a solid metal shaft 6 and a rubber member 8 fitted on the outer circumferential surface of the solid metal shaft 6. The opposite end portions of the backup roller 4 are biased toward the heat roller 2 by a pair of coil springs (not shown). In this structure, a loading portion of the backup roller 6 (i.e., a pressure contact portion of the rubber member 8 to the heat roller 2) is positioned between a pair of biased points against the solid metal shaft 6 at its opposite end portions receiving the biasing forces F from the pair of coil springs.

As mentioned above, in the conventional backup roller, the rubber member is directly fitted on the outer circumferential surface of the solid metal shaft, and the opposite end portions of the solid metal shaft are biased toward the heat roller by the pair of coil springs. Accordingly, an axially central portion of the backup roller tends to be deflected away from the heat roller. This deflection is due to the structure that the loading portion of the backup roller is positioned between the pair of biased points, resulting in a small geometric moment of inertia or second moment of area of the solid metal shaft of the backup roller in respect of the biasing forces of the coil springs.

The structure of the conventional heat roller fixing device mentioned above causes the following problem because of the deflection of the axially central portion of the backup roller away from the heat roller. That is, in the case that the width of a sheet of paper to be used is small in the axial direction of the backup roller, there occurs print shrink in a paper feed direction. The reason for occurrence of the print shrink is that the contact pressure of the backup roller at its axially central portion against the heat roller is reduced to render the paper feed force of the fixing device smaller than the paper feed force of the transfer roller.

The deflection of the backup roller may be prevented by reducing the biasing forces of the coil springs. In this case, however, the paper feed force of the fixing device is undesirably reduced. Further, it may be considered that the diameter of the solid metal shaft is increased to thereby increase the geometric moment of inertia of the solid metal shaft. In this case, however, the fixing device is undesirably enlarged in size.

SUMMARY OF THE INVENTION

It is therefore an object of the present invention to provide a heat roller fixing device which can substantially uniform the amount of deflection of a backup roller over the axial length thereof to improve a paper feed force at an axially central portion of the backup roller.

It is another object of the present invention to provide a heat roller fixing device which can make the deflection of a backup roller follow the deflection of a heat roller to obtain a paper feed force uniformed in the axial direction of the backup roller.

In accordance with an aspect of the present invention, there is provided a toner fixing device comprising a frame; a hollow heat roller rotatably mounted to the frame; a heater inserted in the hollow heat roller; a driving means for rotating the heat roller; a backup roller rotatably mounted to the frame, the backup roller including a hollow cylinder, a solid metal shaft inserted in the hollow cylinder and rotatably mounted to the frame, the solid metal shaft having a pair of large-diameter portions spaced a given distance from each other, each of said large-diameter portions having an outer diameter slightly smaller than an inner diameter of the hollow cylinder, an elastic cylinder formed on an outer cylindrical surface of the hollow cylinder and kept in pressure contact with the heat roller, and fixing means for fixing one of the large-diameter portions of the solid metal shaft to the hollow cylinder; and biasing means for pressing the backup roller against the heat roller, the biasing means biasing the solid metal shaft toward the heat roller.

The pair of large-diameter portions of the solid metal shaft must be positioned in an area where the backup roller is kept in pressure contact with the heat roller. Preferably, the fixing means is configured by inserting a pin in through-holes formed through the solid metal shaft and the hollow cylinder.

According to the present invention, the hollow cylinder is in contact with the solid metal shaft at the pair of large-diameter portions only, and is separate from the solid metal shaft at the other portion thereof. Accordingly, the pair of large-diameter portions of the solid metal shaft becomes a pair of biased points against the hollow cylinder. Since the biased points fall within the axial area of a loading portion (a pressure contact portion between the heat roller and the backup roller), the amount of deflection of the hollow cylinder of the backup roller can be substantially uniformed over the axial length of the backup roller. Accordingly, the paper feed force at the axially central portion of the backup roller can be improved.

In accordance with another aspect of the present invention, there is provided a toner fixing device comprising a frame; a hollow heat roller rotatably mounted to the frame; a heater inserted in the hollow heat roller; a driving means for rotating the heat roller; a backup roller rotatably mounted to the frame, the backup roller including a hollow cylinder, a solid metal shaft inserted in the hollow cylinder and rotatably mounted to the frame, the solid metal shaft having a central large-diameter portion, an elastic cylinder formed on an outer cylindrical surface of the hollow cylinder and kept in pressure contact with the heat roller, and fixing means for fixing the central large-diameter portion of the solid metal shaft to the hollow cylinder; and biasing means for pressing the backup roller against the heat roller, the biasing means biasing the solid metal shaft toward the heat roller, the central large-diameter portion of the solid metal shaft forcing the hollow cylinder toward the heat roller.

According to the another aspect of the present invention, the deflection of the backup roller can be made to follow the deflection of the heat roller. That is, while the solid metal shaft is deflected away from the heat roller, only the central large-diameter portion of the solid metal shaft becomes a biased point against the hollow cylinder, because the hollow cylinder is in contact with the solid metal shaft at the central large-diameter portion only. Accordingly, the hollow cylinder is forced toward the heat roller at only the biased point set at the axially central portion of the backup roller, thereby making the deflection of the backup roller follow the deflection of the heat roller. Accordingly, a paper feed force uniformed in the axial direction of the backup roller can be obtained.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
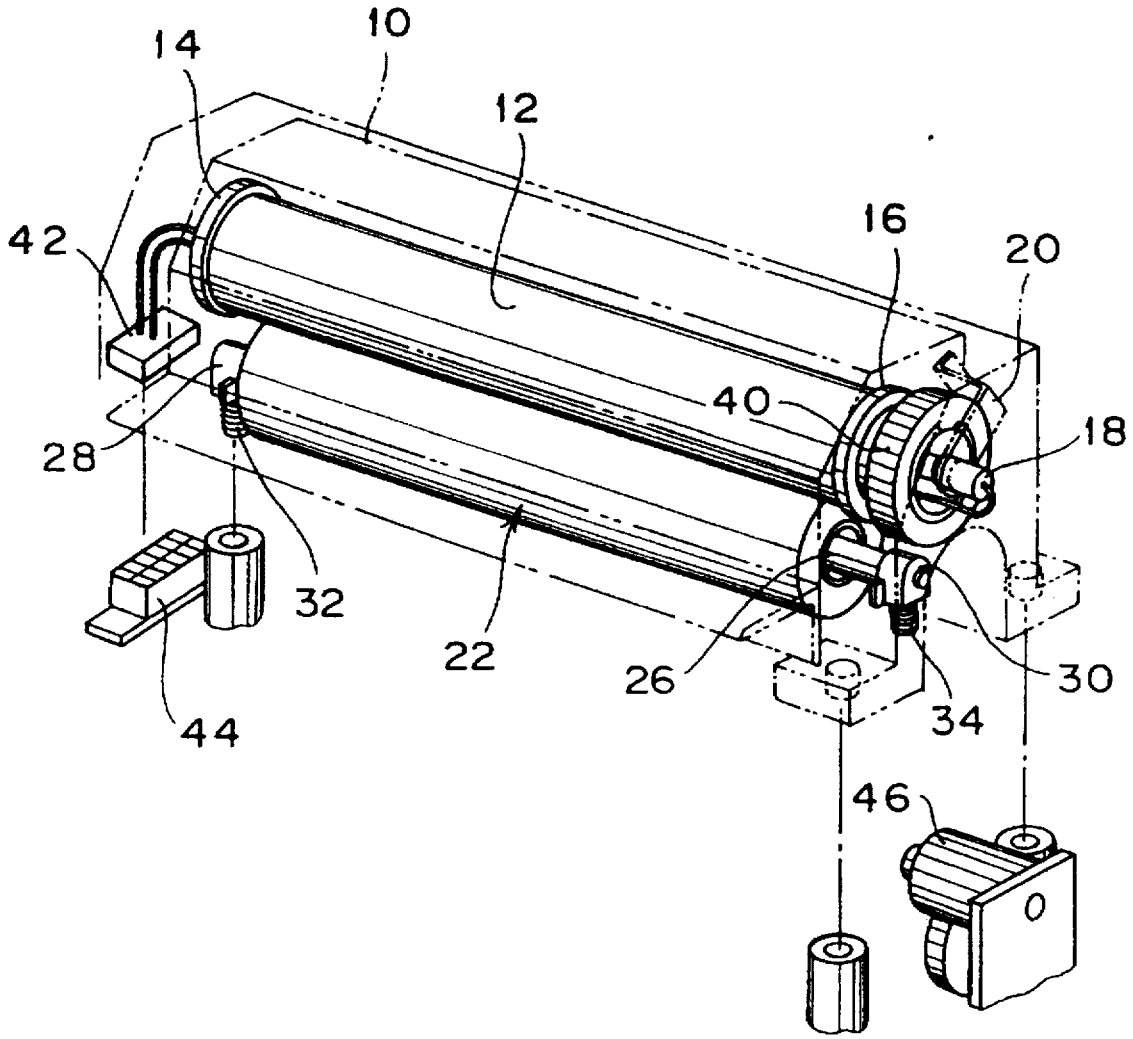
FIG. 1 is perspective view of a heat roller fixing device according to a first preferred embodiment of the present invention.

Referring to FIG. 1, there is shown a perspective view of a heat roller fixing device according to a first preferred embodiment of the present invention. A heat roller 12 is rotatably mounted through a pair of bearings 14 and 16 to a frame 10. The heat roller 12 is formed by coating a fluorine resin on a hollow cylinder of aluminum. A heater 18 such as a halogen lamp is inserted in the heat roller 12 and is fixed to the frame 10 by a heater fixing member 20 so as to be substantially aligned with the heat roller 12. The heater 18 is electrically connected to a connector 42, which is in turn electrically connected to a connector 44 provided on the side of a printer (not shown), whereby when an electric current is supplied to the heater 18, it generates heat to thereby heat the surface of the heat roller 12 to high temperatures.

A thermistor (not shown) is in contact with the surface of the heat roller 12 through an insulator, so as to control the supply of the electric current to the heater 18 according to the resistance of the thermistor and thereby control the surface temperature of the heat roller 12 within a predetermined range. While the heat roller 12 is rotatably mounted through the bearings 14 and 16 to the frame 10, the heat roller 12 is fixed both in its axial direction by stop rings and in its radial direction by the engagement of the bearings 14 and 16 with bearing mounting holes formed in the frame 10.

Figure 3:
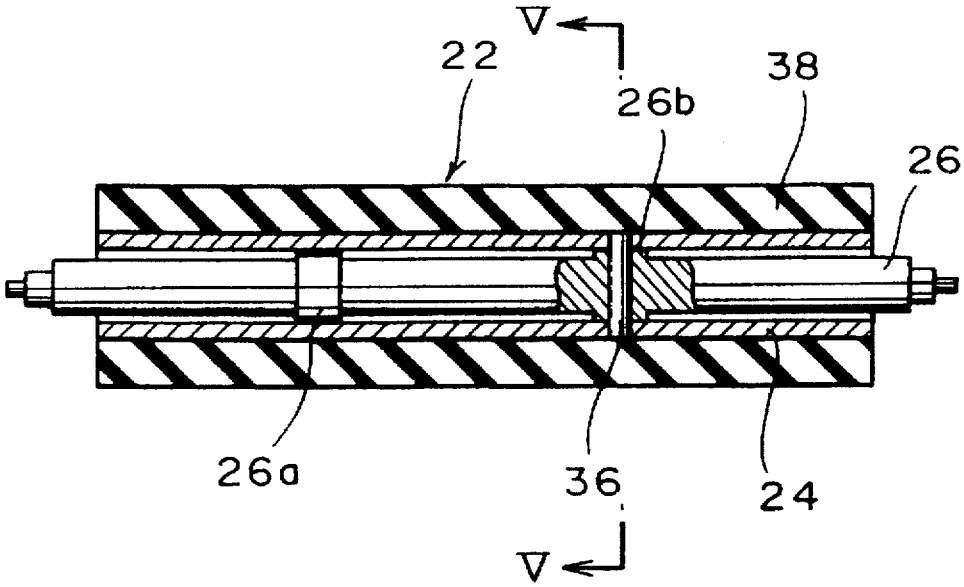
FIG. 3 is a sectional view of a backup roller in the first preferred embodiment.

Reference numeral 22 denotes a backup roller (pressure roller). As best shown in FIG. 3, the backup roller 22 consists essentially of a hollow cylinder 24 of aluminum alloy, a solid metal shaft 26 inserted in the hollow cylinder 24, and an elastic member 38 of rubber, porous materials, etc. fitted over the cylindrical surface of the hollow cylinder 24. The solid metal shaft 26 is formed of carbon steel, for example.

The solid metal shaft 26 has a pair of large-diameter portions **26*a* and 26*b* each having an outer diameter slightly smaller than the inner diameter of the hollow cylinder 24. The large-diameter portions 26*a* and 26*b* are spaced a given distance from each other. Preferably, this distance between the large-diameter portions 26*a* and 26*b* is set to about 170 mm in the case that the length of the solid metal shaft 26 between its two supported points is set to 340 mm and the length of the hollow cylinder 24 is set to 310 mm. The outer cylindrical surface of the backup roller 22 (i.e., the outer cylindrical surface of the elastic member 38**) is fully covered with a fluorine tube for preventing deposition of toner.

Figure 5:
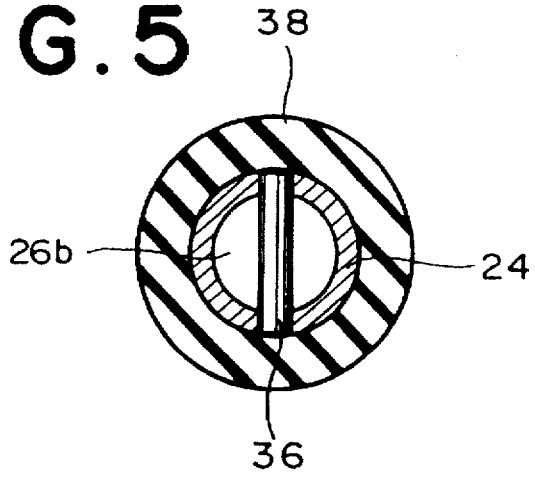
FIG. 5 is a cross section taken along the line V—V in FIG. 3.

As best shown in FIG. 5, the large-diameter portion **26*b* of the solid metal shaft 26 is formed with a diametrically extending through-hole, and the hollow cylinder 24 is also formed with two, diametrically-opposed through-holes aligned with the through-hole of the large-diameter portion 26*b*. A pin 36 is inserted in these through-holes of the large-diameter portion 26*b* and the hollow cylinder 24, thereby fixing the hollow cylinder 24 to the solid metal shaft 26**.

Figure 2:
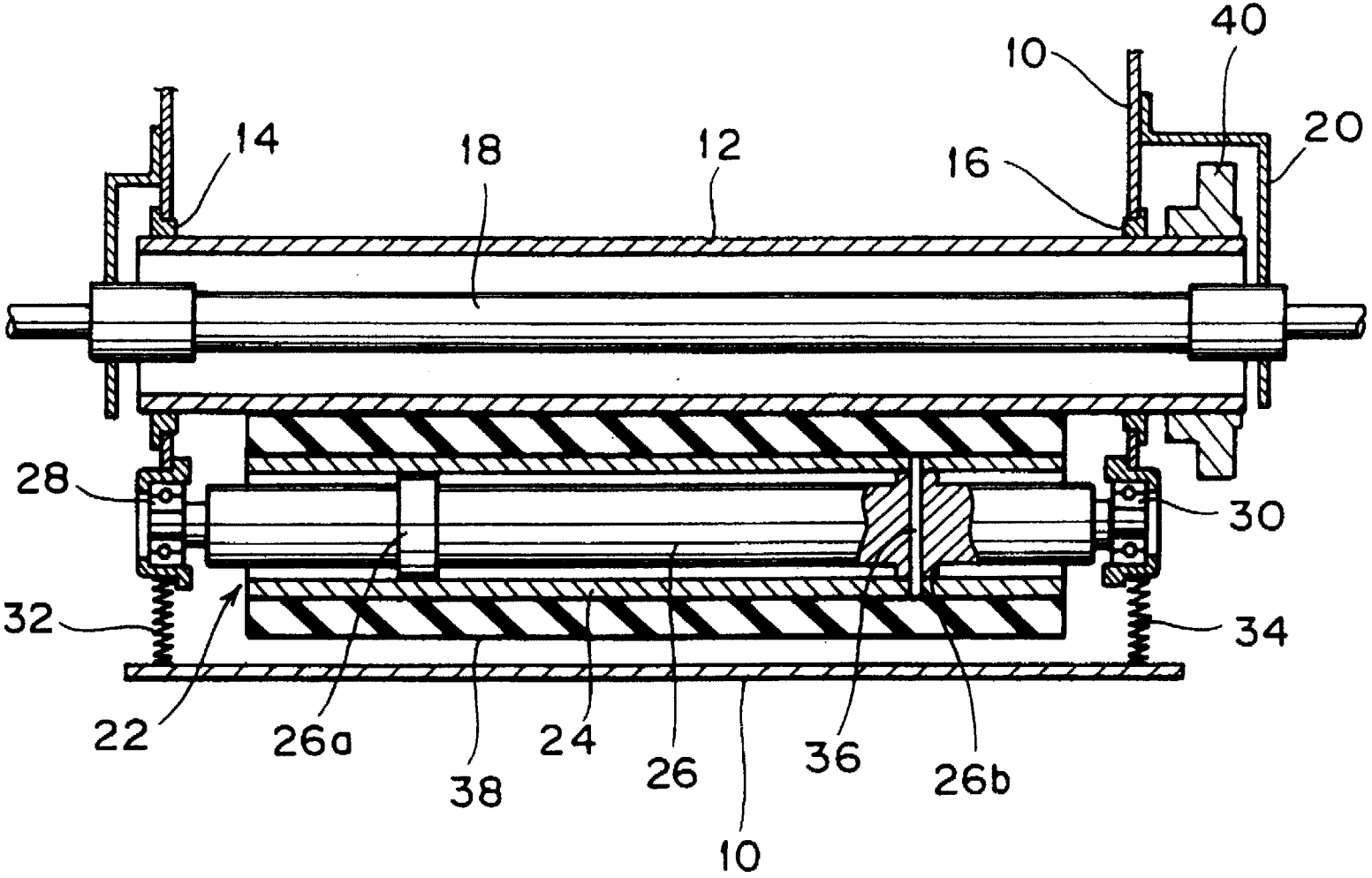
FIG. 2 is a sectional view of the heat roller fixing device shown in FIG. 1.
Figure 4:
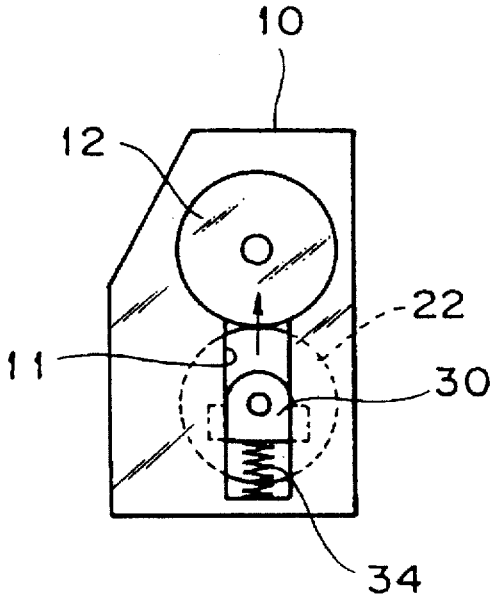
FIG. 4 a side view of the heat roller fixing device shown in FIG. 1.

The solid metal shaft 26 of the backup roller 22 is rotatably supported through a pair of bearings 28 and 30 to the frame 10. As best shown in FIG. 2, the backup roller 22 is kept in pressure contact with the heat roller 12 by a pair of coil springs 32 and 34. That is, as shown in FIG. 4 which is a side elevation, the frame 10 is formed with a guide groove 11, and the bearing 30 is guided within the guide groove 11 to be moved by the biasing force of the coil spring 34. Although not shown, the other bearing 28 is similarly moved by the biasing force of the other coil spring 32.

Referring again to FIG. 1, a gear 40 is mounted on the heat roller 12 at its one end portion. The heat roller fixing device is fixed by screws to the printer at given positions therein so that the gear 40 meshes with a gear 46 mounted on the printer. Thus, the heat roller 12 is rotated by driving a drive motor (not shown). As mentioned above, the backup roller 22 is kept in pressure contact with the heat roller 12 by the coil springs 32 and 34. Accordingly, when the heat roller 12 is rotated, the backup roller 22 follows the rotation of the heat roller 12 to rotate owing to the pressure against the heat roller 12 and the friction against the heat roller 12 or a sheet of paper fed between the two rollers 12 and 22.

In the condition where the backup roller 22 is biased to the heat roller 12, the elastic member 38 of the backup roller 22 is deformed by the pressure, thereby obtaining a given nip width of the backup roller 22 kept in pressure contact with the heat roller 12. This nip width ensures a flat area where the paper comes into tight contact with the heat roller 12 to obtain enough time for melting of the toner on the paper by the heat from the heat roller 12, thus fixing a toner image on the paper.

Figure 6:
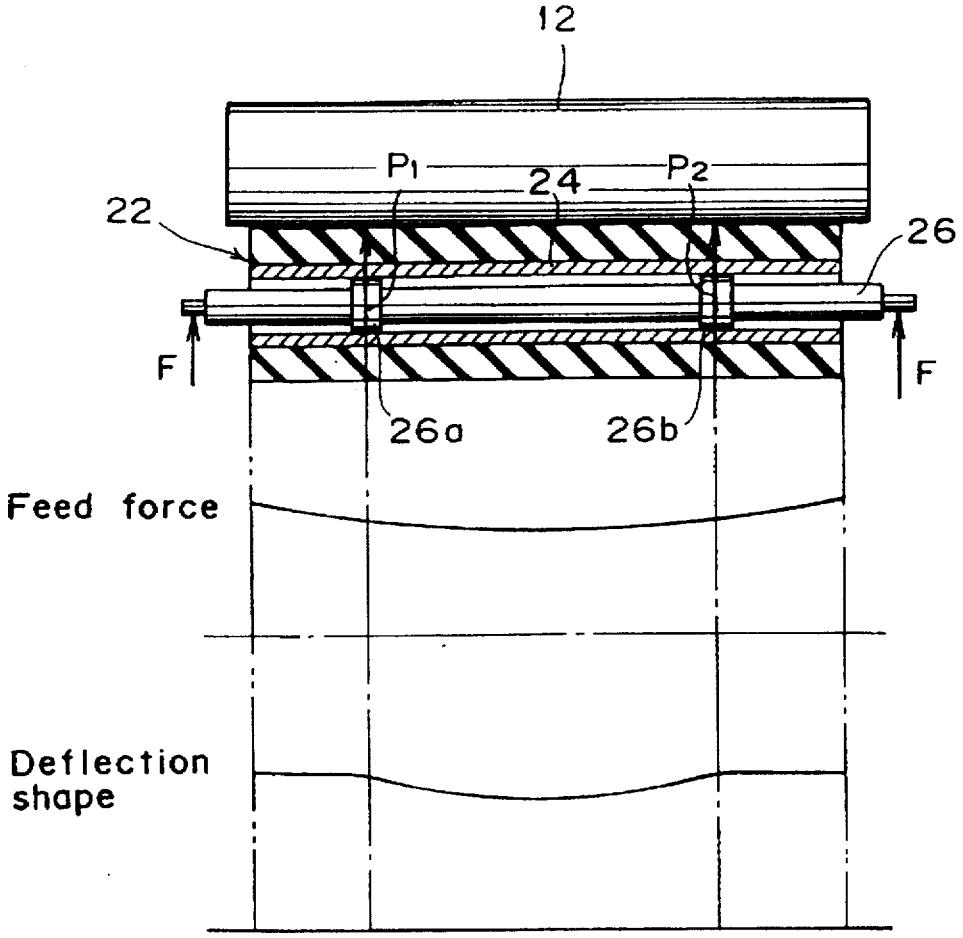
FIG. 6 is a view illustrating a feed force and a deflection shape of the backup roller in the first preferred embodiment.

Referring to FIG. 6, when forces F are applied from the coil springs 32 and 34 to the opposite end portions of the solid metal shaft 26 toward the heat roller 12, only the pair of large-diameter portions 26*a* and 26*b* of the solid metal shaft 26 are in contact with the inner cylindrical surface of the hollow cylinder 24. That is, the biased points against the hollow cylinder 24 are set at positions P1 and P2 of the large-diameter portions 26*a* and 26*b*. In the other area excepting the biased points P1 and P2, the hollow cylinder 24 is separate from the solid metal shaft 26.

As apparent from FIG. 6, the biased points P1 and P2 against the hollow cylinder 24 are positioned in an axial loading area, that is, in a pressure contact area of the backup roller 22 against the heat roller 12. When the solid metal shaft 26 is biased at its opposite end portions toward the heat roller 12 by the coil springs 32 and 34, deflection of the solid metal shaft 26 occurs. However, since the biased points P1 and P2 against the hollow cylinder 24 are positioned in the loading area, the solid metal shaft 26 is hardly deflected.

Accordingly, the amount of deflection of the backup roller 22 can be substantially uniformed over the axial length thereof, thereby improving a paper feed force at an axially central portion of the backup roller 22. As a result, even when the width of the paper in the axial direction of the backup roller 22 is small, the occurrence of print shrink in a paper feed direction can be prevented.

Figure 7:
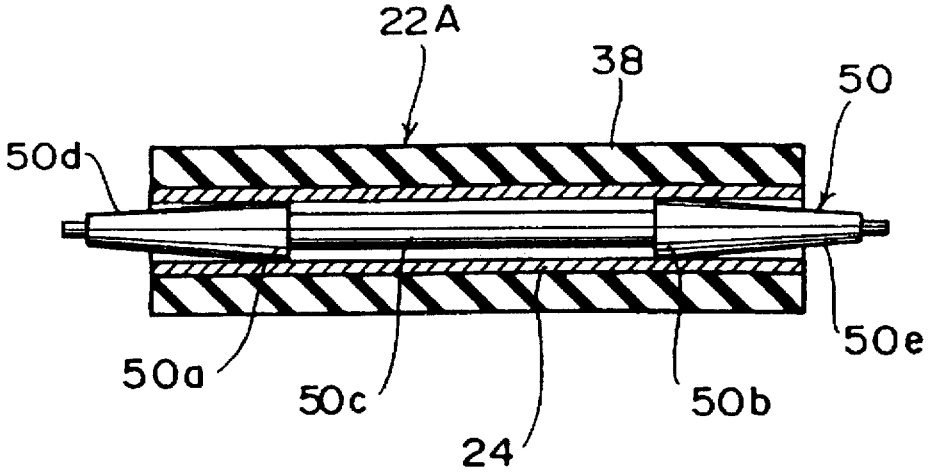
FIG. 7 is a sectional view of a backup roller according to a second preferred embodiment of the present invention.

Referring next to FIG. 7, there is shown a sectional view of a backup roller 22A according to a second preferred embodiment of the present invention. The backup roller 22A employs a solid metal shaft 50 having a pair of large-diameter portions 50*a* and 50*b* spaced a given distance from each other, an intermediate small-diameter portion 50*c* formed between the large-diameter portions 50*a* and 50*b*, and a pair of tapering portions 50*d* and 50*e* tapering from the large-diameter portions 50*a* and 50*b* to the opposite ends of the shaft 50, respectively.

Each of the large-diameter portions 50*a* and 50*b* has an outer diameter slightly smaller than the inner diameter of a hollow cylinder 24. Like the first preferred embodiment, an elastic member 38 of rubber or the like is fitted over the outer cylindrical surface of the hollow cylinder 24. According to this preferred embodiment, the solid metal shaft 50 has the tapering portions 50*d* and 50*e* respectively continuing from the large-diameter portions 50*a* and 50*b*, thereby enlarging a geometric moment of inertia to minimize the deflection of the solid metal shaft 50.

Figure 8:
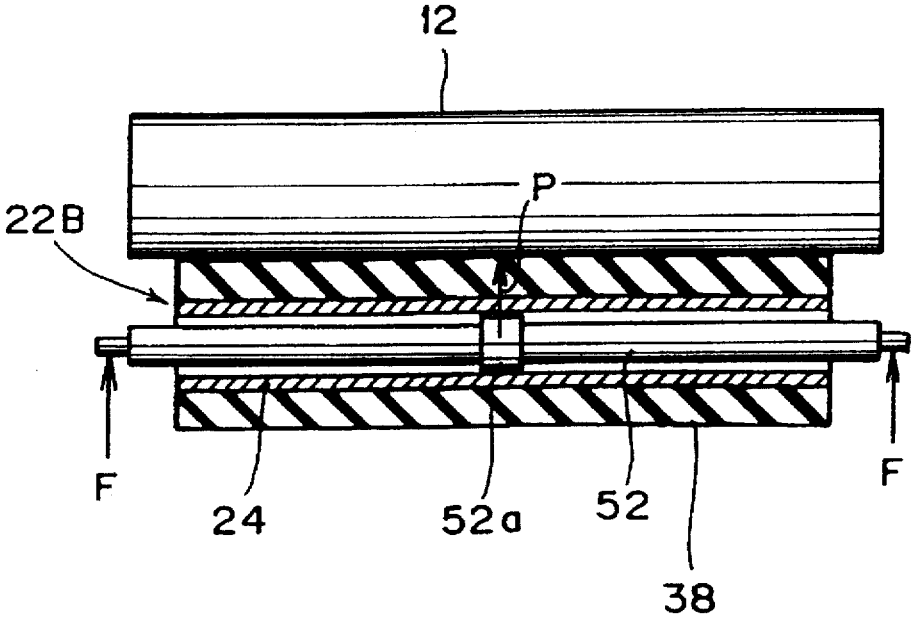
FIG. 8 is a sectional view of a backup roller according to a third preferred embodiment of the present invention.

Referring next to FIG. 8, there is shown a sectional view of a backup roller 22B according to a third preferred embodiment of the present invention. The backup roller 22B employs a solid metal shaft 52 having a central large-diameter portion 52*a*. The central large-diameter portion 52*a* of the solid metal shaft 52 is fixed to a hollow cylinder 24 by welding, for example. The fixing of the large-diameter portion 52*a* to the hollow cylinder 24 may be effected by any other methods such as screwing or pinning like the first preferred embodiment, instead of welding.

Figure 9:
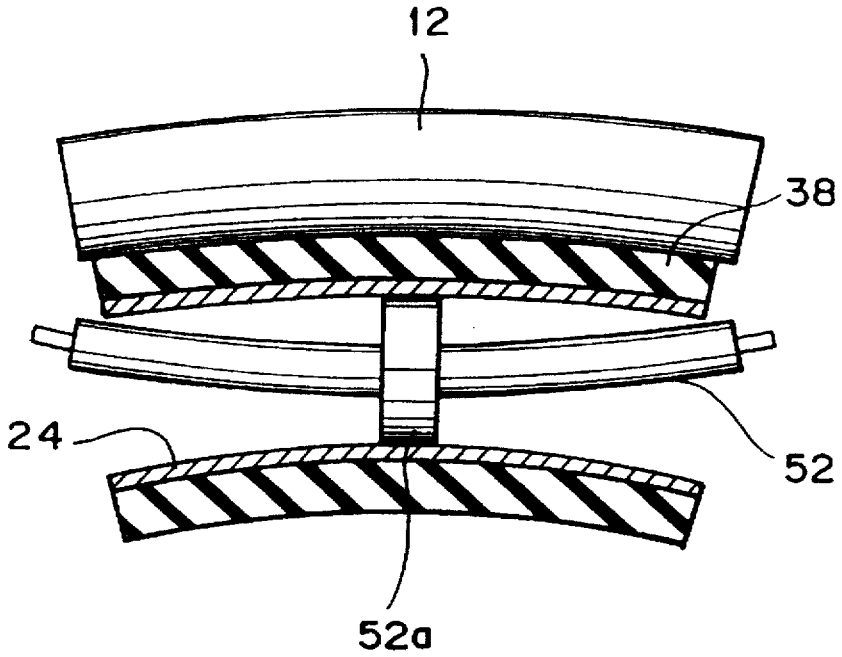
FIG. 9 is a view illustrating a deflection shape in the third preferred embodiment.

Like the first preferred embodiment, an elastic member 38 of rubber or the like is fitted over the outer cylindrical surface of the hollow cylinder 24. When forces F are applied to the opposite end portions of the solid metal shaft 52 by coil springs (not shown in FIG. 8), the solid metal shaft 52 is deflected as shown in FIG. 9. In this preferred embodiment, however, a biased point P against the hollow cylinder 24 is positioned at the central large-diameter portion 52*a* of the solid metal shaft 52 which portion 52*a* only is kept in contact with the hollow cylinder 24. Accordingly, the hollow cylinder 24 is deflected in a direction opposite to the direction of deflection of the solid metal shaft 52, thereby making the deflection of the backup roller 22B (i.e., the deflection of the hollow cylinder 24) follow the deflection of a heat roller 12. As a result, it is possible to obtain a paper feed force uniformed in the axial direction of the backup roller 22B according to this preferred embodiment.

In general, the deflection of a heat roller is much smaller than the deflection of a backup roller. Therefore, in the first and second preferred embodiments, the deflection of the heat roller is neglected and the amount of deflection of the backup roller is substantially uniformed over the axial length thereof. In contrast, according to the third preferred embodiment, the deflection of the heat roller is not neglected, but it is followed by the deflection of the backup roller.

Figure 10:
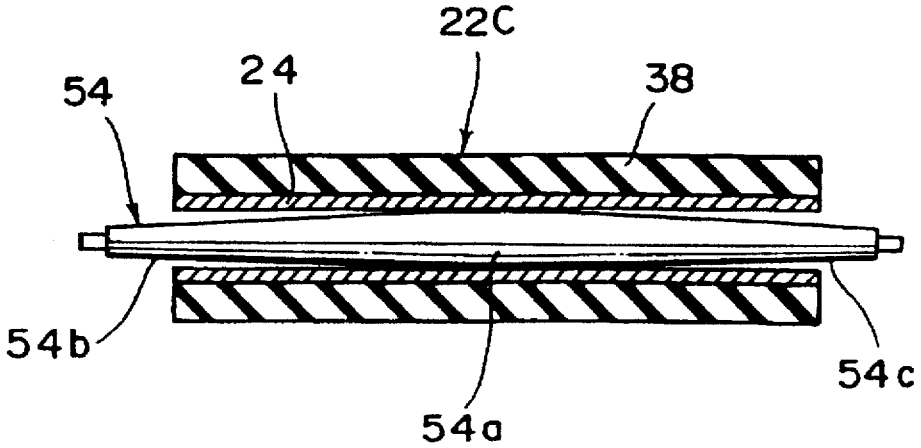
FIG. 10 is a sectional view of a backup roller according to a fourth preferred embodiment of the present invention.
Figure 11:
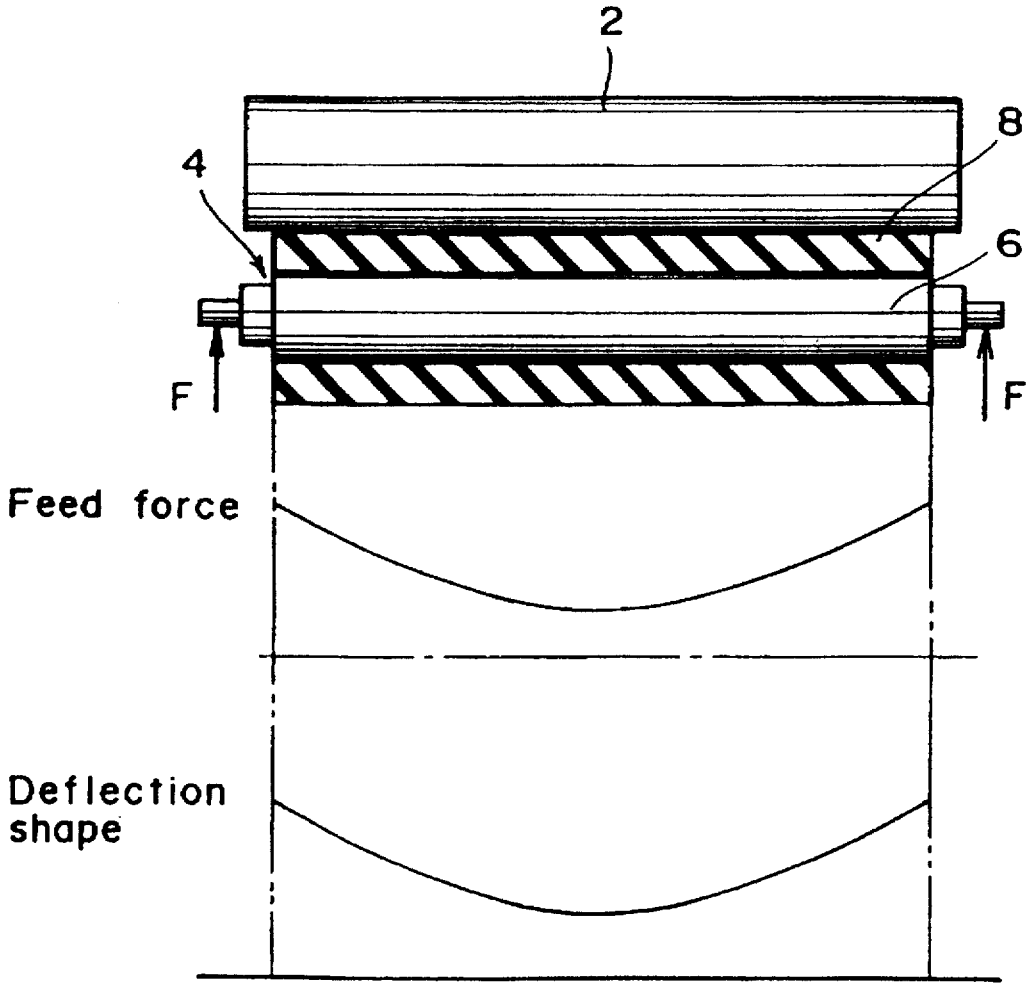
FIG. 11 PRIOR ART
FIG. 11 is a view illustrating a feed force and a deflection shape of a backup roller in the prior art.

Referring next to FIG. 10, there is shown a sectional view of a backup roller 22C according to a fourth preferred embodiment of the present invention. The backup roller 22C employs a solid metal shaft 54 having a central large-diameter portion 54*a* and a pair of tapering portions 54*b* and 54*c* tapering from the central large-diameter portion 54*a* toward the opposite ends of the shaft 54. According to this preferred embodiment, the geometric moment of inertia of the solid metal shaft 54 can be made larger than that of the solid metal shaft 52 in the third preferred embodiment, thereby more suppressing the deflection of the solid metal shaft 54. The configuration and operation of other parts are similar to those in the third preferred embodiment.

According to the present invention, the amount of deflection of the backup roller can be substantially uniformed over the axial length thereof to thereby improve a paper feed force at the axially central portion of the backup roller. Accordingly, the occurrence of print shrink in a paper feed direction can be prevented. Furthermore, in the third and fourth preferred embodiments, the deflection of the backup roller can be made to follow the deflection of the heat roller, thereby obtaining a paper feed force uniformed in the axial direction of the backup roller.

What is claimed is:

1. A toner fixing device comprising:

a frame;

a hollow heat roller rotatably mounted to said frame;

a heater inserted in said hollow heat roller;

a driving means for rotating said heat roller;

a backup roller rotatably mounted to said frame, said backup roller including a hollow cylinder, a solid metal shaft inserted in said hollow cylinder and rotatably mounted to said frame, said solid metal shaft having a pair of large-diameter portions integrally formed thereon and spaced a given distance from each other, each of said large-diameter portions having an outer diameter slightly smaller than an inner diameter of said hollow cylinder, an elastic cylinder formed on an outer cylindrical surface of said hollow cylinder and kept in pressure contact with said heat roller, wherein said pair of large-diameter portions are positioned in an area where said elastic cylinder is kept in pressure contact with said heat roller, and fixing means for fixing one of said large-diameter portions of said solid metal shaft to said hollow cylinder; and biasing means for pressing said backup roller against said heat roller, said biasing means biasing said solid metal shaft toward said heat roller.

2. A toner fixing device comprising:

a frame;

a hollow heat roller rotatably mounted to said frame;

a heater inserted in said hollow heat roller;

a driving means for rotating said heat roller;

a backup roller rotatably mounted to said frame, said backup roller including a hollow cylinder, a solid metal shaft inserted in said hollow cylinder and rotatably mounted to said frame, said solid metal shaft having a pair of large-diameter portions spaced a given distance from each other, each of said large-diameter portions having an outer diameter slightly smaller than an inner diameter of said hollow cylinder, an elastic cylinder formed on an outer cylindrical surface of said hollow cylinder and kept in pressure contact with said heat roller, said pair of large-diameter portions being positioned in an area where said elastic cylinder is kept in pressure contact with said heat roller, and fixing means for fixing one of said large-diameter portions of said solid metal shaft to said hollow cylinder; and biasing means for pressing said backup roller against said heat roller, said biasing means biasing said solid metal shaft toward said heat roller;

said fixing means comprising a first through-hole passing through said one large-diameter portion of said solid metal shaft, a second through-hole formed through said hollow cylinder so as to be aligned with said first through-hole, and a pin inserted in said first and second through-holes.

3. A toner fixing device comprising:

a frame;

a hollow heat roller rotatably mounted to said frame;

a heater inserted in said hollow heat roller;

a driving means for rotating said heat roller;

a backup roller rotatably mounted to said frame, said backup roller including a hollow cylinder, a solid metal shaft inserted in said hollow cylinder and rotatably mounted to said frame, said solid metal shaft having a pair of large-diameter portions spaced a given distance from each other, each of said large-diameter portions having an outer diameter slightly smaller than an inner diameter of said hollow cylinder, an elastic cylinder formed on an outer cylindrical surface of said hollow cylinder and kept in pressure contact with said heat roller, said pair of large-diameter portions being positioned in an area where said elastic cylinder is kept in pressure contact with said heat roller, and fixing means for fixing one of said large-diameter portions of said solid metal shaft to said hollow cylinder; and biasing means for pressing said backup roller against said heat roller, said biasing means biasing said solid metal shaft toward said heat roller;

wherein said solid metal shaft further has an intermediate small-diameter portion formed between said large-diameter portions, and a pair of tapering portions tapering from said large-diameter portions toward opposite ends of said shaft.

4. A toner fixing device comprising:

a frame;

a hollow heat roller rotatably mounted to said frame;

a heater inserted in said hollow heat roller;

a driving means for rotating said heat roller;

a backup roller rotatably mounted to said frame, said backup roller including a hollow cylinder, a solid metal shaft inserted in said hollow cylinder and rotatably mounted to said frame, said solid metal shaft having a central large-diameter portion, an elastic cylinder formed on an outer cylindrical surface of said hollow cylinder and kept in pressure contact with said heat roller, and fixing means for fixing said central large-diameter portion of said solid metal shaft to said hollow cylinder solely at said central large-diameter portion; and biasing means for pressing said backup roller against said heat roller, said biasing means biasing said solid metal shaft toward said heat roller, said central large-diameter portion of said solid metal shaft forcing said hollow cylinder toward said heat roller.

5. A toner fixing device according to claim 4, wherein said solid metal shaft further has a pair of tapering portions tapering from said central large-diameter portion toward opposite ends of said shaft.

* * * * *